US011821428B2

(12) United States Patent
Yamazaki et al.

(10) Patent No.: US 11,821,428 B2
(45) Date of Patent: Nov. 21, 2023

(54) MOTOR-INTEGRATED FLUID MACHINE

(71) Applicant: Hitachi Industrial Equipment Systems Co., Ltd., Tokyo (JP)

(72) Inventors: Shumpei Yamazaki, Tokyo (JP); Yoshiyuki Kanemoto, Tokyo (JP); Fuminori Kato, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 1347 days.

(21) Appl. No.: 16/316,869

(22) PCT Filed: Jul. 15, 2016

(86) PCT No.: PCT/JP2016/070965
§ 371 (c)(1),
(2) Date: Jul. 8, 2019

(87) PCT Pub. No.: WO2018/011970
PCT Pub. Date: Jan. 18, 2018

(65) Prior Publication Data

US 2023/0184252 A1 Jun. 15, 2023

(51) Int. Cl.
*F04C 29/04* (2006.01)
*F04B 39/06* (2006.01)
*F04C 2/04* (2006.01)

(52) U.S. Cl.
CPC ..... *F04C 2/04* (2013.01); *F04B 39/06* (2013.01)

(58) Field of Classification Search
CPC ..... F04C 29/04; F04C 29/047; F04C 29/042; F04C 29/045; F04C 18/0215;
(Continued)

(56) References Cited

U.S. PATENT DOCUMENTS 6,190,145 B1 2/2001 Fujioka et al.
8,979,515 B2 * 3/2015 Iwano ..... F01C 21/06 418/101
(Continued)

FOREIGN PATENT DOCUMENTS

CN 101012827 A 8/2007
CN 103850942 A 6/2014
(Continued)

OTHER PUBLICATIONS

Partial English-language translation of document B6 (JP 64-51789 U previously filed on Jan. 10, 2019) (three (3) pages).
(Continued)

*Primary Examiner* — Mickey H France
*Assistant Examiner* — Dapinder Singh
(74) *Attorney, Agent, or Firm* — Crowell & Moring LLP

(57) ABSTRACT

Provided is a motor-integrated fluid machine that has improved performance and reliability by efficiently cooling a fluid machine body and a motor without increasing an installation space. The present invention is characterized by being provided with: a fluid machine unit that compresses or expands a fluid; a motor unit that has a drive shaft connected to the fluid machine unit; and a cooling fan that cools the motor unit and the fluid machine unit by sucking cooling air from the motor unit side and that is connected to the drive shaft at the side opposed to that connected to the fluid machine unit, wherein between the motor unit and the cooling fan, the minimum sectional area of a cooling air passage from the outside in the radial direction toward the drive shaft is larger than that of a cooling air passage from the motor unit side toward the cooling fan.

18 Claims, 3 Drawing Sheets

(58) Field of Classification Search
CPC ..... F04C 18/0223; F04C 15/0096; F04C 23/008; F04C 2240/30; F04B 39/06
See application file for complete search history.

(56) References Cited

U.S. PATENT DOCUMENTS

| | | | | |
|---|---|---|---|---|
| 2014/0097715 | A1* | 4/2014 | Hall | H02K 5/16 310/59 |
| 2014/0154122 | A1 | 6/2014 | Sadakata et al. | |
| 2018/0152081 | A1* | 5/2018 | Sakai | H02K 11/40 |

FOREIGN PATENT DOCUMENTS

| | | | |
|---|---|---|---|
| CN | 105201825 | A | 12/2015 |
| EP | 0 994 258 | A1 | 4/2000 |
| JP | 63-118397 | U | 7/1988 |
| JP | 64-51789 | U | 3/1989 |
| JP | 2000-291574 | A | 10/2000 |
| JP | 2002-130161 | A | 5/2002 |
| JP | 2007-321563 | A | 12/2007 |
| JP | 4625193 | B2 | 2/2011 |
| JP | 2014-105693 | A | 6/2014 |
| JP | 2015-68247 | A | 4/2015 |

OTHER PUBLICATIONS

Extended European Search Report issued in European Application No. 16908871.3 dated Jan. 24, 2020 (10 pages).
International Search Report (PCT/ISA/210) issued in PCT Application No. PCT/JP2016/070965 dated Oct. 18, 2016 with English translation (four (4) pages).
Japanese-language Written Opinion (PCT/ISA/237) issued in PCT Application No. PCT/JP2016/070965 dated Oct. 18, 2016 (five (5) pages).
Chinese-language Office Action issued in counterpart Chinese Application No. 201680087688.9 dated Aug. 22, 2019 with Unverified English translation (21 pages).

* cited by examiner

MOTOR-INTEGRATED FLUID MACHINE

TECHNICAL FIELD

The present invention relates to a motor-integrated fluid machine.

BACKGROUND ART

A patent literature 1 discloses a fluid machine that cools a motor and a fluid machine body by covering the motor with a cooling air guide which conducts cooling air discharged from a cooling fan to the fluid machine body.

A patent literature 2 discloses a fluid machine that cools a fluid machine body by conducting cooling air discharged from a cooling fan to the fluid machine body with a cooling air guide.

CITATION LIST

Patent Literature

PTL 1: Japanese Patent No. 4625193

PTL 2: Japanese Patent Application Laid-Open No. 2014-105693

SUMMARY OF INVENTION

Technical Problem

In a motor-integrated fluid machine in which a fluid machine body and a motor are integrated, temperature rise of each part occurs because of heat by compression of fluid and heat generation of a bearing and the motor. As the temperature rise of compression space deteriorates performance because of deterioration of compression efficiency and the temperature rise of the motor and the bearing deteriorates reliability because of deterioration of the part, it is important to efficiently cool the fluid machine body and the motor.

In the fluid machine disclosed in Patent Literature 1 in which the fluid machine body and the motor are integrated, to cool the fluid machine body and the motor, the motor is covered with a cooling air guide that conducts cooling air discharged from a cooling fan to the fluid machine body. Therefore, as cooling air is discharged from the cooling fan and flows along the motor in the cooling air guide, the motor is cooled and afterward, the fluid machine body is cooled. In this structure, as a cooling air suction opening of the cooling fan is provided on the reverse side to the motor in an axial direction, space for air intake is required to be secured outside the fluid machine in the axial direction and Patent Literature 1 has a problem that space required for installation increases. In addition, as only a part covered with the cooling air guide cools the motor and no cooling air flows in a part except the part, Patent Literature 1 has a problem that the motor is not sufficiently cooled.

In a fluid machine disclosed in a patent literature 2 in which a fluid machine body and a motor are integrated, a cooling air suction opening of a cooling fan is provided on the motor side in an axial direction and the fluid machine body is efficiently cooled by devising a sectional shape of a cooling air guide that conducts cooling air discharged from the cooling fan to the fluid machine body. In this structure, as cooling air is sucked from clearance between the motor and the cooling air guide, sufficient cooling air cannot be sucked when this distance is short and Patent Literature 2 has a problem that the fluid machine body is not sufficiently cooled. In addition, cooling of the motor is not considered.

Then, an object of the present invention is to provide a motor-integrated fluid machine enhanced in performance and reliability by efficiently cooling a fluid machine body and a motor without increasing installation space.

Solution to Problem

To settle the abovementioned problems, for one example of the motor-integrated fluid machine according to the present invention, there can be given a motor-integrated fluid machine provided with a fluid machine unit that compresses or expands fluid, a motor unit including a drive shaft connected to the fluid machine unit, a rotor integrally rotated with the drive shaft, a stator that applies torque to the rotor and a motor casing that houses the rotor and the stator and a cooling fan that is connected to the reverse side to the fluid machine unit of the drive shaft, sucks cooling air from the motor unit side, and cools the motor unit and the fluid machine unit, and having a characteristic that minimum sectional area of a cooling air passage between the motor unit and the cooling fan from the diametrical outside toward the drive shaft is larger than minimum sectional area of a cooling air passage from the motor unit side to the cooling fan.

In addition, for another example of the motor-integrated fluid machine according to the present invention, there can be given a motor-integrated fluid machine provided with a fluid machine unit that compresses or expands fluid, a motor unit including a drive shaft connected to the fluid machine unit, a rotor integrally rotated with the drive shaft, a stator that applies torque to the rotor and a motor casing that houses the rotor and the stator, a cooling fan that is connected to the reverse side to the fluid machine unit of the drive shaft, sucks cooling air from the motor unit side, and cools the fluid machine unit and the motor unit, and a fan cover that houses the cooling fan, and having a characteristic that when a maximum diameter of an opening on the motor casing side of the fan cover shall be D, the area of the opening shall be S and distance between the opening and the motor casing shall be h, "$h>S/(\pi D)$" is met.

ADVANTAGEOUS EFFECTS OF INVENTION

According to the present invention, the motor-integrated fluid machine in which the fluid machine body and the motor can be efficiently cooled by reducing suction loss of cooling air and securing cooling air without increasing installation space, performance and reliability are enhanced can be provided.

DESCRIPTION OF EMBODIMENTS

Figure 1:
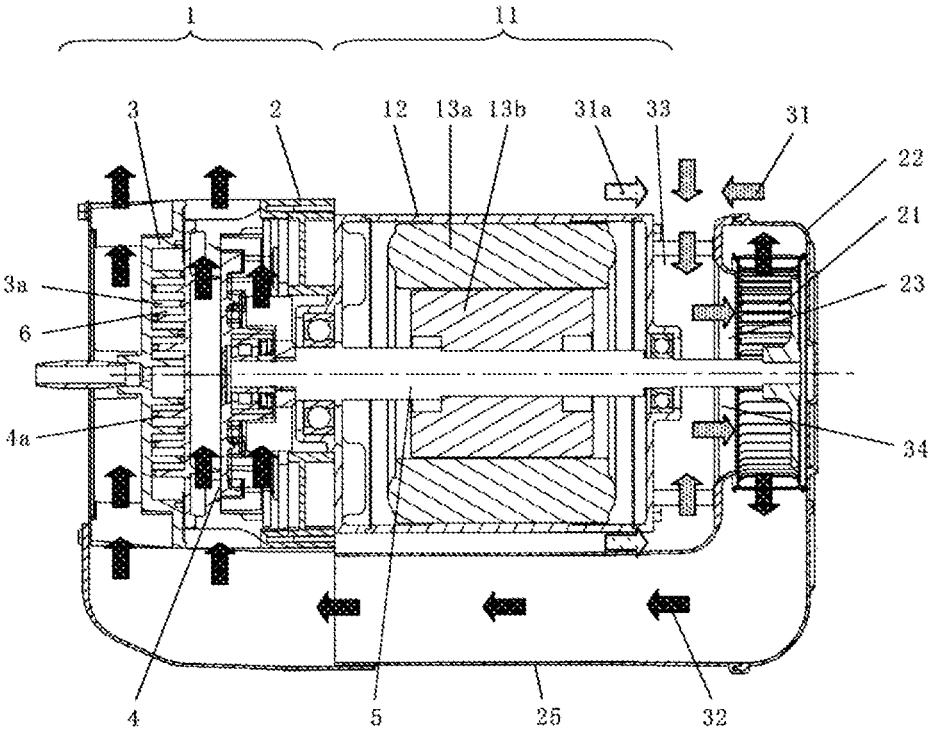
FIG. 1 is a cross-sectional view showing a motor-integrated fluid machine in an example 1 of the present invention.

Fluid machines according to embodiments of the present invention will be described using a motor-integrated scroll air compressor for an example referring to the attached drawings below. In each drawing for explaining the embodiments, the same names and reference numerals are allocated to the same components and repeated description is omitted.

Example 1

FIG. 1 is a cross-sectional view showing a motor-integrated fluid machine in an example 1. A reference numeral 1 denotes a compressor unit as a whole. A reference numeral 2 denotes a compressor casing configuring an outer shell of the compressor unit 1, a reference numeral 3 denotes a fixed scroll which is provided to the compressor casing 2 and on which a scrolled lap 3*a* is erected, and a reference numeral 4 denotes a revolving scroll on which a scrolled lap 4*a* is erected. The revolving scroll 4 is driven via a drive shaft 5 being a rotating shaft of a motor and an eccentric portion (not shown) provided to an end on the side of the compressor unit 1 of the drive shaft 5. The lap 4*a* of the revolving scroll 4 forms plural compression spaces 6 between the lap 4*a* and the lap 3*a* of the fixed scroll 3.

Accordingly, the revolving scroll 4 performs compression by performing a revolving motion according to an autorotation prevention mechanism (not shown) provided among the drive shaft 5, the compressor casing 2 and the revolving scroll 4 and reducing the compression space 6 configured between the revolving scroll and the fixed scroll 3 toward the center.

A motor unit 11 that drives the compressor unit 1 is configured by a motor casing 12, a stator 13*a* and a rotor 13*b* respectively housed in the motor casing and is coupled to the drive shaft 5 attached to the rotor 13*b* in a state in which the drive shaft pierces the rotor 13*b*.

A cooling fan 21 is housed inside a fan cover 22 attached on the reverse side to the compressor unit 1 of the drive shaft 5 and a cooling air suction opening 23 is open on the side of the motor unit 11 in an axial direction. An air guide duct 25 communicates with the cooling fan 21 and the compressor unit 1.

A flow of cooling air in this example will be described below. The cooling fan 21 is rotated by driving the motor unit 11, sucks cooling air 31 on the suction side from the cooling air suction opening 23 open in the axial direction, and discharges cooling air 32 on the discharge side into the fan cover 22.

The cooling air 31 on the suck side passes a diametrical cooling air passage 33 formed between an end face of the motor casing 12 and the fan cover 22 from the outside of the fluid machine and reaches the cooling fan suction opening 23 via an axial cooling air passage 34. At this time, a part of cooling air that flows into the diametrical cooling air passage 33 is motor casing side cooling air 31*a* sucked along a diametrical side of the motor casing 12 and performs cooling of the motor unit 11.

The cooling air 32 on the discharge side cools the fixed scroll 3 by flowing from the fan cover 22 into the air guide duct 25, flowing into the compressor unit 1 and flowing along the back of the fixed scroll lap 3*a*, and the cooling air cools the revolving scroll 4 by flowing along the back of the revolving scroll lap 4*a*.

Next, relation between the diametrical cooling air passage 33 and the axial cooling air passage 34 in this example will be described using FIG. 2 being a schematic diagram of the cooling air passage. Cooling air 31 on the suction side flows in the diametrical cooling air passage 33 from the diametrical outer peripheral side to the inner peripheral side and afterward, flows in the axial cooling air passage 34 from the side of the motor unit 11 to the side of the cooling fan 21. In this case, cooling air transit sectional area $S_1$ of the diametrical cooling air passage 33 is equivalent to the area of a substantially cylindrical side (a curved part) shown in FIG. 2 and is proportional to distance between the end face of the motor casing 12 and the fan cover 22 and distance (a radius) from the center of the axis. In the meantime, cooling air transit sectional area $S_2$ of the axial cooling air passage 34 is equivalent to the area of a substantially cylindrical section (a plane) shown in FIG. 2 and is equivalent to area acquired by subtracting sectional area of the drive shaft 5 from axial sectional area of the fan cover 22 for conducting the cooling air to the cooling air suction opening 23. It is for a characteristic of this example that relation between a minimum value (minimum sectional area) $S_{1min}$ of the cooling air transit sectional area $S_1$ in the diametrical cooling air passage 33 from the diametrical outside toward the drive shaft and a minimum value (minimum sectional area) $S_{2min}$ of the cooling air transit sectional area $S_2$ of the axial cooling air passage 34 from the motor unit side to the cooling fan is set to "$S_{1min}>S_{2min}$".

For example, distance between the end face of the motor casing 12 and the fan cover 22 shall be a fixed value h independent of a location in the fluid machine in FIG. 1. For the smallest part in diameter in the axial cooling air passage 34, a diameter of the cooling air suction opening 23 shall be D and a diameter of the drive shaft 5 in the cooling air suction opening 23 shall be d. At this time, the minimum value $S_{1min}$ of the cooling air transit sectional area $S_1$ of the diametrical cooling air passage 33 is equivalent to transit sectional area in the diameter D of the cooling air suction opening 23 and $S_{1min}=\pi Dh$. In the meantime, the minimum value $S_{2min}$ of the cooling air transit sectional area $S_2$ of the axial cooling air passage 34 is equivalent to "$S_{2min}=\pi(D^2-d^2)/4$". In this case, a condition on which each cooling air passage has the abovementioned relation is "$h>(D^2-d^2)/(4D)$" and this expression means that the distance h between the wall face of the motor casing 12 and the fan cover 22 is larger than the fixed value determined on the basis of the diameter D of the cooling air suction opening 23 and the diameter d of the drive shaft 5 in the cooling air suction opening 23.

In addition, as the minimum value of the diametrical cooling air passage is $\pi Dh$ when a maximum diameter of an opening of the axial cooling air passage 34 shall be D and the area of the opening shall be S, relation in $h>S/(\pi D)$ has only to be met if the diameter d of the drive shaft is small.

As described above, a decrease of cooling air capacity by loss in the diametrical cooling air passage 33 due to a clearance flow having large resistance for a flow in the same sectional area is prevented by making the minimum value of the sectional area $S_1$ in a flow direction (in the diametrical direction) of the diametrical cooling air passage 33 larger than the minimum value of the sectional area $S_2$ in a flow direction (in the axial direction) of the axial cooling air passage 34, and performance and reliability can be enhanced by efficiently cooling the compressor unit 1. Moreover, as no air intake space is required to be axially provided outside the compressor because the cooling air suction opening 23 is open on the side of the motor unit 11 in the axial direction, installation space can be reduced and further, as motor casing side cooling air 31*a* flows along the whole periphery of the motor casing 12, the motor unit 11 is efficiently cooled and reliability can be enhanced.

Figure 2:
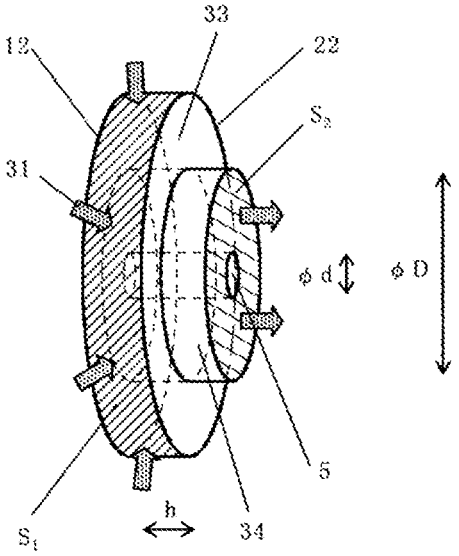
FIG. 2 is a schematic diagram showing a flow of cooling air on the suction side of the motor-integrated fluid machine in the example 1 of the present invention.

In this example, the cooling air transit sectional area $S_1$ of the diametrical cooling air passage 33 is equivalent to the substantially cylindrical side (the curved part) shown in FIG. 2 using the example that the distance between the wall face of the motor casing 12 and the fan cover 22 is fixed; however, even if axial height of a substantial cylindrical shape varies according to a circumferential position, the cooling air transit sectional area $S_1$ can be defined for the area of the side. In addition, similarly, even if the axial cooling air passage 34 is not circular, the cooling air transit sectional area $S_2$ can be defined for sectional area in a direction perpendicular to the axis.

For the cooling fan 21, an axial fan that discharges cooling air on the discharge side 32 on the reverse side in the axial direction to the cooling air suction opening 23 can also be used; however, increase of an axial dimension of the fluid machine is inhibited by using a centrifugal fan that discharges cooling air on the discharge side 32 outside in the diametrical direction, in addition, guidance of the cooling air on the discharge side 32 in a direction of the compressor unit 1 is facilitated, and the structure can be simplified.

Further, in Japanese Patent Application Laid-Open No. 2014-105693 (Patent Literature 2), the configuration that the compressor body and the motor are connected via a drive shaft, the cooling fan is attached on the reverse side to the compressor body of the drive shaft and the cooling air suction opening is open on the axial motor side is disclosed. However, in Patent Literature 2, no relation between a diametrical cooling air passage and an axial cooling air passage is considered, in addition, cooling of the motor by cooling air on the suction side is also not researched, and this example cannot be easily realized on the basis of Patent Literature 2.

Example 2

Figure 3:
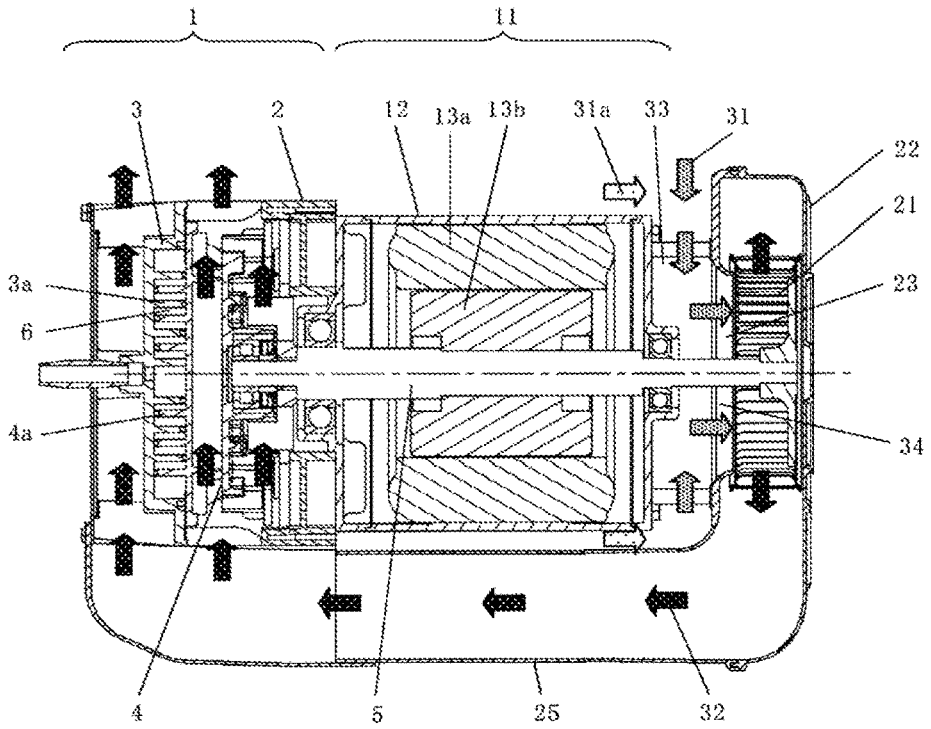
FIG. 3 is a cross-sectional view showing a motor-integrated fluid machine in an example 2 of the present invention.

An example 2 of the present invention will be described referring to FIG. 3 below. The same reference numeral is allocated to the same configuration as that in the example 1 and its description is omitted. The example 2 has a characteristic that in a similar motor-integrated fluid machine to that in the example 1, a part except a part that communicates with an air guide duct 25 of a fan cover 22 is protruded outside a motor casing 12 in a diametrical direction. As shown in FIG. 3, a rate of motor casing side cooling air 31*a* increases in cooling air that flows into a diametrical cooling air passage 33.

In this example, in addition to the effects of the example 1, a flow direction of cooling air that flows into the diametrical cooling air passage 33 is regulated by the fan cover 22, as the motor casing side cooling air 31*a* increases, a motor unit 11 can be more efficiently cooled, and the reliability can be enhanced.

Example 3

Figure 4:
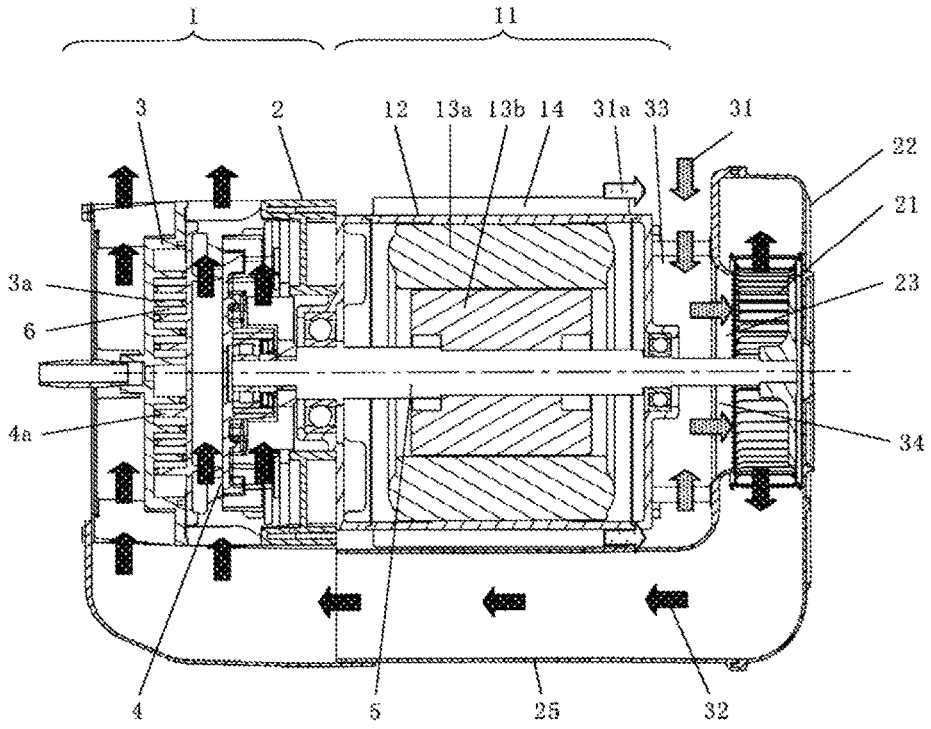
FIG. 4 is a cross-sectional view showing a motor-integrated fluid machine in an example 3 of the present invention.

An example 3 of the present invention will be described referring to FIG. 4 below. The same reference numeral is allocated to the same configuration as that in the example 1 and its description is omitted. The example 3 has a characteristic that in a similar motor-integrated fluid machine to that in the example 1, a motor cooling fin 14 is provided to an outer peripheral surface of a motor casing 12 long in an axial direction. As shown in FIG. 4, a motor casing side cooling air 31*a* flows along the motor cooling fin 14 from the side of a compressor unit 1 toward a cooling fan 21.

In this example, in addition to the effects of the example 1, as the motor casing side cooling air 31*a* flows without being obstructed by the motor cooling fin 14 when the motor casing side cooling air flows around the motor casing 12, a motor unit 11 can be more efficiently cooled and the reliability can be enhanced.

Example 4

Figure 5:
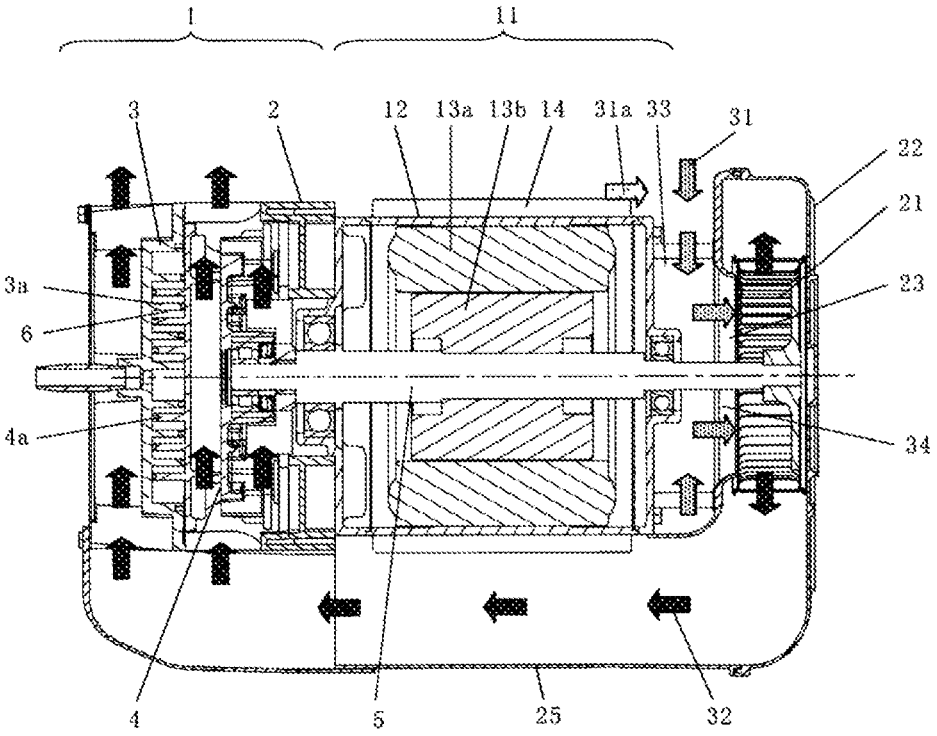
FIG. 5 is a cross-sectional view showing a motor-integrated fluid machine in an example 4 of the present invention.

An example 4 of the present invention will be described referring to FIG. 5 below. The same reference numeral is allocated to the same configuration as that in the example 1 and its description is omitted. The example 4 has a characteristic that in a similar motor-integrated fluid machine to that in the example 1, a part of an air guide duct 25 is open to a motor casing 12 and a wall face of the motor casing 12 is made to function as a part of a passage that communicates with a cooling fan 21 and a compressor unit 1. As shown in FIG. 5, cooling air that flows from the cooling fan 21 toward the compressor unit 1 flows along a side of the motor casing 12 and cools a motor unit 11.

In this example, in addition to the effects of the example 1, the motor unit 11 can be more efficiently cooled by making faster cooling air on the discharge side 32 in flow velocity than a motor casing side cooling air 31*a* flow along the side of the motor casing 12 and the reliability can be enhanced.

In the abovementioned examples, the scroll air compressors have been described for the examples of the fluid machine; however, the present invention is not limited to these and can also be applied to a reciprocating compressor and a screw compressor respectively driven by a motor. In addition, the present invention can also be applied to a fluid machine driven by a motor, for example, an expander not just the compressor. Moreover, for a motor, the radial gap type motor is used; however, an axial gap type motor the axial dimension of which can be reduced can be applied.

The examples described above only show one example of embodiment in realizing the present invention and a technical scope of the present invention should not be restrictively interpreted by these. That is, the present invention can be realized in various manners without deviating from its technical ideas or its principal characteristics.

REFERENCE SIGNS LIST

1—compressor unit,
2—compressor casing,
3—fixed scroll,
3*a*—fixed scroll lap,
4—revolving scroll,
4*a*—revolving scroll lap,
5—drive shaft,
6—compression space,
11—motor unit,
12—motor casing,
13*a*—stator,
13*b*—rotor,
14—motor cooling fin,
21—cooling fan,
22—fan cover,

23—cooling air suction opening,
25—air guide duct,
31—cooling air on suction side,
31*a*—motor casing side cooling air,
32—cooling air on discharge side,
33—diametrical cooling air passage,
34—axial cooling air passage.

The invention claimed is:

1. A motor-integrated fluid machine, comprising:
a fluid machine unit that compresses or expands fluid;
a motor unit provided with a drive shaft connected to the fluid machine unit, a rotor integrally rotated with the drive shaft, a stator that applies torque to the rotor, and a motor casing that houses the rotor and the stator;
a cooling fan that is connected to a reverse side to the fluid machine unit of the drive shaft, sucks cooling air from a motor unit side, and cools the motor unit and the fluid machine unit; and
a fan cover that covers a part of a diametrical outside of the cooling fan and the reverse side to the motor unit,
wherein the cooling fan discharges cooling air outside in a diametrical direction; and a
minimum sectional area of a cooling air passage from the diametrical outside toward the drive shaft formed between a side of the motor casing and the fan cover opposite to the motor casing side between the motor unit and the cooling fan is larger than the minimum sectional area of a cooling air passage from the motor unit side to the cooling fan.

2. The motor-integrated fluid machine according to claim 1, comprising an air guide duct that connects the fan cover and the fluid machine unit.

3. The motor-integrated fluid machine according to claim 2, wherein cooling air flows from the cooling fan toward the fluid machine unit between the air guide duct and the fluid machine unit.

4. The motor-integrated fluid machine according to claim 1,
wherein the fluid machine unit includes:
an end plate and a lap;
a revolving scroll that is connected to the motor unit and that performs a revolving motion; and
a fixed scroll having a lap arranged opposite to a lap of the revolving scroll.

5. The motor-integrated fluid machine according to claim 4, wherein cooling air supplied from the air guide duct cools a face on the reverse side to a face on which the lap of an end plate of the fixed scroll is formed and a face on the reverse side to a face on which the lap of an end plate of the revolving scroll is formed.

6. The motor-integrated fluid machine according to claim 1, comprising a cooling fin provided to an outer peripheral surface of the motor casing long in a direction from the fluid machine unit toward the cooling fan.

7. The motor-integrated fluid machine according to claim 1, wherein a diametrical dimension of the fan cover is made longer than a diametrical dimension of the motor casing.

8. The motor-integrated fluid machine according to claim 1,
wherein a part of an outer peripheral surface of the motor casing is cooled by cooling air from the fluid machine unit side toward the cooling fan; and
the remaining part is cooled by cooling air from the cooling fan to the fluid machine unit side.

9. The motor-integrated fluid machine according to claim 1, wherein the motor unit is an axial gap motor.

10. A motor-integrated fluid machine, comprising:
a fluid machine unit that compresses or expands fluid;
a motor unit provided with a drive shaft connected to the fluid machine unit, a rotor integrally rotated with the drive shaft, a stator that applies torque to the rotor, and a motor casing that houses the rotor and the stator;
a cooling fan that is connected to a reverse side to the fluid machine unit of the drive shaft, sucks cooling air from a motor unit side, and cools the fluid machine unit and the motor unit; and
a fan cover that houses the cooling fan, wherein:
the cooling fan discharges cooling air outside in a diametrical direction;
the fan cover covers a part of a diametrical outside of the cooling fan and the reverse side to the motor unit; and
when a maximum diameter of an opening on the motor casing side of the fan cover shall be D, an area of the opening shall be S and a distance between a wall face of the motor casing and the fan cover opposite to the motor casing wall face shall be h, an expression, $h>S/(\pi D)$ is met.

11. The motor-integrated fluid machine according to claim 10, comprising an air guide duct that connects the fan cover and the fluid machine unit.

12. The motor-integrated fluid machine according to claim 11, wherein cooling air flows from the cooling fan toward the fluid machine unit between the air guide duct and the fluid machine unit.

13. The motor-integrated fluid machine according to claim 10,
wherein the fluid machine unit includes:
an end plate and a lap;
a revolving scroll that is connected to the motor unit and that performs a revolving motion; and
a fixed scroll having a lap arranged opposite to a lap of the revolving scroll.

14. The motor-integrated fluid machine according to claim 13, wherein cooling air supplied from the air guide duct cools a face on the reverse side to a face on which the lap of an end plate of the fixed scroll is formed and a face on the reverse side to a face on which the lap of an end plate of the revolving scroll is formed.

15. The motor-integrated fluid machine according to claim 10, comprising a cooling fin provided to an outer peripheral surface of the motor casing long in a direction from the fluid machine unit toward the cooling fan.

16. The motor-integrated fluid machine according to claim 10, wherein a diametrical dimension of the fan cover is made longer than a diametrical dimension of the motor casing.

17. The motor-integrated fluid machine according to claim 10,
wherein a part of the outer peripheral surface of the motor casing is cooled by cooling air from the fluid machine unit side toward the cooling fan; and
the remaining part is cooled by cooling air from the cooling fan toward the fluid machine unit side.

18. The motor-integrated fluid machine according to claim 10, wherein the motor unit is an axial gap motor.

* * * * *